US005723182A

United States Patent [19]

Choi et al.

[11] Patent Number: 5,723,182

[45] Date of Patent: Mar. 3, 1998

[54] METHOD FOR COATING LEATHER

[75] Inventors: Chol-Yoo Choi, Bensalem; Patricia Marie Lesko, Ottsville; Katherine Sue Rice, Glenside, all of Pa.

[73] Assignee: Rohm and Haas Company, Philadelphia, Pa.

[21] Appl. No.: 707,988

[22] Filed: Aug. 27, 1996

[51] Int. Cl.[6] ..... B05D 7/12

[52] U.S. Cl. ..... 427/389; 524/558; 524/560; 524/561

[58] Field of Search ..... 524/558, 560, 524/561; 427/389

[56] References Cited

U.S. PATENT DOCUMENTS

| | | | |
|---|---|---|---|
| 4,107,120 | 8/1978 | Plamondon et al. | 260/29.6 |
| 4,150,005 | 4/1979 | Gehman et al. | 260/29.6 |
| 4,491,612 | 1/1985 | Fischer et al. | 427/412 |
| 4,814,373 | 3/1989 | Frankel et al. | 524/460 |
| 5,185,387 | 2/1993 | Klesse et al. | 523/201 |
| 5,288,809 | 2/1994 | Christner et al. | 427/447 |

FOREIGN PATENT DOCUMENTS

| | | |
|---|---|---|
| 348565 | 1/1990 | European Pat. Off. . |

*Primary Examiner*—Erma Cameron
*Attorney, Agent, or Firm*—Ronald D. Bakule

[57] ABSTRACT

An aqueous leather coating composition and a method for coating leather with the aqueous coating composition containing a multi-stage emulsion polymer which has been contacted with a transition metal oxide, hydroxide, or carbonate is provided. The leather coating fulfills desirable protective and aesthetic functions.

6 Claims, No Drawings

METHOD FOR COATING LEATHER

This invention relates to a method for coating leather. This invention also relates to an aqueous composition suitable for use in coating leather. More particularly, this invention relates to a method for coating leather with an aqueous coating composition containing a multi-stage emulsion polymer, the lower Tg polymer stage of which contains a copolymerized carboxylic acid and which has been contacted with a divalent metal oxide, hydroxide, or carbonate.

The present invention serves to provide a protective coating that is aesthetically pleasing. The protective properties of the leather coating are measured by the flexing endurance under both dry and wet conditions, and resistance to damage when rubbed. The coating may be subsequently embossed with the desired imprint in a heated press. The softness of the final coated leather, the ability of the coating to be embossed easily without clinging to the heated press and the retention of the desired imprint are measured aesthetic properties of the coated leather.

U.S. Pat. No. 5,185,387 discloses an aqueous leather grounding (coating) containing an emulsion polymer having a core-shell structure. The core-shell emulsions have a non-crosslinked shell having a glass transition temperature below 60 C. and a crosslinked core with a glass transition temperature of below 0 C. and also at least 10 C. below the glass transition temperature of the shell material. The crosslinking in the core is achieved by the use of copolymerizable monomers containing at least two ethylenically unsaturated groups such as allyl, acryl, or methacryl groups. However, the use of such crosslinkers leads to unsatisfactory flexing resistance of the resulting leather coatings.

U.S. Pat. No. 5,149,745 discloses the reaction of divalent metal oxides, hydroxides, or carbonates to acid-containing polymer dispersions at a temperature above the glass transition temperature of the polymer. Coatings containing a reacted polymer having from 4% to 90% acid-functional monomers and having a Tg above room temperature are disclosed.

U.S. Pat. No. 4,150,005 discloses an internally plasticized polymer latex prepared by a multi-stage emulsion polymerization process. The first stage is highly water-swellable or water-soluble; the principal second or later stage is less hydrophilic and of higher Tg than the first stage. The polymer latex is disclosed to be suitable for use in coatings in general or as impregnants and adhesives for materials including leather. Also disclosed is the use of zinc-ammonium complexes for crosslinking of floor polish compositions. However, the use of such crosslinkers requires the use of a high level of ammonia and its resultant odor and the tendency of the latex composition to flocculate on addition of the zinc-ammonium complex to the latex makes it undesirable to use these crosslinkers.

The problem faced by the inventors is the provision of a method for coating leather with an aqueous coating composition capable of facile formation without using a substantial level of ammonia and which yields a dried coating on leather that has good embossing plate release, good print quality, satisfactory flexing endurance under wet and dry conditions, and good wet abrasion resistance.

In a first aspect of the present invention there is provided a method for coating leather comprising (a) forming an aqueous coating composition comprising a multi-stage aqueous emulsion-polymer formed by a method comprising (i) forming a predominantly acrylic first stage polymer comprising at least one copolymerized ethylenically unsaturated monomer and from 0.5% to 10% of a copolymerized monoethylenically-unsaturated carboxylic acid monomer, based on the weight of first stage polymer, the first stage polymer being substantially free from copolymerized multi-ethylenically unsaturated monomer; and the first stage polymer having a Tg of less than 20 C.; (ii) contacting the first stage polymer with a transition metal oxide, hydroxide, or carbonate at a pH of less than 9 in an amount greater then 0.1 equivalent of transition metal per equivalent of the copolymerized carboxylic acid monomer in the first stage; and (iii) forming a second stage polymer comprising at least one copolymerized ethylenically unsaturated monomer and from 0% to 10% of a copolymerized monoethylenically-unsaturated carboxylic acid monomer, based on the weight of second stage polymer, provided that the second stage copolymerized carboxylic acid monomer is less than 25%, by weight, of the total copolymerized carboxylic acid monomer in the multi-stage emulsion polymer, the second stage polymer being substantially free from copolymerized multi-ethylenically unsaturated monomer; the second stage polymer having a Tg of greater than 20 C. and at least 10 C. higher than the Tg of the first stage polymer; and the second stage polymer being from 1% to 50% of the weight of the first stage polymer, based on dry polymer weights; (b) applying the coating composition to leather; and (c) drying the coating composition.

In a second aspect of the present invention there is provided an aqueous composition for use in coating leather comprising a multi-stage aqueous emulsion-polymer comprising (i) a predominantly acrylic first stage polymer comprising at least one copolymerized ethylenically unsaturated monomer and from 0.5% to 10% of a copolymerized monoethylenically-unsaturated carboxylic acid monomer, based on the weight of the first stage polymer, the first stage polymer being substantially free from copolymerized multi-ethylenically unsaturated monomer; and the first stage polymer having a Tg of less than 20 C.; the first stage polymer having been contacted with a transition metal oxide, hydroxide, or carbonate at a pH of less than 9 in an amount greater than 0.1 equivalent of divalent metal per equivalent of the copolymerized carboxylic acid monomer in the first stage polymer; and (ii) a second stage polymer comprising at least one copolymerized ethylenically unsaturated monomer and from 0% to 10% of a copolymerized monoethylenically-unsaturated carboxylic acid monomer, based on the weight of the second stage polymer, provided that the second stage copolymerized carboxylic acid monomer is less than 25%, by weight, of the total copolymerized carboxylic acid monomer in the multi-stage emulsion polymer, the second stage polymer being substantially free from copolymerized multi-ethylenically unsaturated monomer; the second stage polymer having a Tg of greater than 20 C. and at least 10 C. higher than the Tg of the first stage polymer; and the second stage polymer being from 1% to 50% of the weight of the first stage polymer, based on dry polymer weights.

This invention relates to a method for coating leather and a composition for use in coating leather related to a multi-stage polymer prepared by emulsion polymerization.

The multi-stage emulsion polymer contains a predominantly acrylic first stage polymer comprising at least one copolymerized ethylenically unsaturated monomer and from 0.5% to 10% of a copolymerized monoethylenically-unsaturated carboxylic acid monomer, based on the weight of the first stage polymer, the first stage polymer being substantially free from copolymerized multi-ethylenically unsaturated monomer. By "predominantly acrylic first stage polymer" is meant that greater than 50% of the copolymerized monomers forming the first stage polymer are acrylic, i.e., that they are selected from esters, amides, etc. of (meth)acrylic acid, (meth)acrylonitrile, and the like. The first stage polymer contains at least one copolymerized ethylenically unsaturated monomer such as, for example, a (meth)acrylic ester monomer including methyl acrylate, ethyl acrylate, butyl acrylate, 2-ethylhexyl acrylate, decyl acrylate, methyl methacrylate, butyl methacrylate, hydroxyethyl methacrylate, hydroxypropyl methacrylate, aminoalkyl (meth)acrylates; styrene or substituted styrenes; butadiene; vinyl acetate or other vinyl esters; vinyl monomers such as vinyl chloride, vinylidene chloride, N-vinyl pyrollidone; and acrylonitrile or methacrylonitrile. The use of the term "(meth)" followed by another term such as acrylate or acrylamide, as used throughout the disclosure, refers to both acrylates or acrylamides and methacrylates and methacrylamides, respectively.

The first stage polymer also contains from 0.5% to 10%, preferably from 1% to 5%, of a copolymerized monoethylenically-unsaturated carboxylic acid monomer, based on the weight of the first stage polymer, such as, for example, acrylic acid, methacrylic acid, crotonic acid, itaconic acid, fumaric acid, maleic acid, monomethyl itaconate, monomethyl fumarate, monobutyl fumarate, and maleic anhydride.

The first stage polymer used in this invention is substantially free from copolymerized multi-ethylenically unsaturated monomers such as, for example, allyl methacrylate, diallyl phthalate, 1,4-butylene glycol dimethacrylate, 1,2-ethylene glycol dimethacrylate, 1,6-hexanediol diacrylate, and divinyl benzene. By "substantially free from copolymerized multi-ethylenically unsaturated monomers" is meant that levels less than 0.1% based on the weight of the first stage polymer such as might be adventitiously introduced as impurities in monoethylenically-unsaturated monomers are not excluded.

The glass transition temperature ("Tg") of the first stage polymer is less than 20 C., as measured by differential scanning calorimetry (DSC) using the mid-point in the heat flow versus temperature transition as the Tg value. Chain transfer agents such as, for example, mercaptans may be used in an mount effective to provide lower molecular weights.

The first stage polymer is contacted with a transition metal oxide, hydroxide, or carbonate at pH less than pH=9, preferably at pH=3–6, in an amount greater than 0.1 equivalent of transition metal per equivalent of copolymerized carboxylic acid monomer in the first stage polymer according to the process disclosed in U.S. Pat. No. 5,221,284. The oxides, hydroxides, and carbonates of zinc, aluminum, tin, tungsten, and zirconium are preferred for low cost, low toxicity, and low color in the dried coating. Zinc oxide is more preferred. The transition metal oxide, hydroxide, or carbonate may be added slurried in water, optionally with an added dispersant such as, for example a low molecular weight polymer or copolymer of (meth)acrylic acid. The transition metal oxide, hydroxide, or carbonate may be added during the polymerization process or after the polymerization of one or more stages has been completed.

The multi-stage polymer also contains a second stage polymer comprising at least one copolymerized ethylenically unsaturated monomer and from 0% to 10% of a copolymerized monoethylenically-unsaturated carboxylic acid monomer, based on the weight of the second stage polymer, provided that the second stage copolymerized carboxylic acid monomer in the multi-stage copolymer; the second stage polymer being substantially free from copolymerized multi-ethylenically unsaturated monomer; the second stage polymer having a Tg of greater than 20 C. and at least 10 C. higher than the Tg of the first stage polymer; and the second stage polymer being from 1% to 50% of the weight of the first stage polymer, based on dry polymer weights. The copolymerized ethylenically unsaturated monomer, copolymerized monoethylenically-unsaturated carboxylic acid monomer, and copolymerized multi-ethylenically unsaturated monomer of the second stage polymer are defined and exemplified as for the first stage polymer herein.

The polymerization techniques used to prepare such aqueous multi-stage emulsion-polymers are well known in the art such as, for example, U.S. Pat. Nos. 4,325,856; 4,654,397; and 4,814,373.

In the multi-stage polymerization process at least two stages differing in composition are formed in sequential fashion. Conventional surfactants may be used such as, for example, anionic and/or nonionic emulsifiers such as, for example, alkali metal or ammonium alkyl sulfates, alkyl sulfonic acids, fatty acids, and oxyethylated alkyl phenols. The amount of surfactant used is usually 0.1% to 6% by weight, based on the weight of total monomer. Either thermal or redox initiation processes may be used. The monomer mixture for a stage may be added neat or as an emulsion in water. The monomer mixture for a stage may be added in one or more additions or continuously over the reaction period allotted for that stage. Addition of each stage in a single portion is preferred. Conventional free radical initiators may be used such as, for example, hydrogen peroxide, t-butyl hydroperoxide, ammonium and/or alkali persulfates, typically at a level of 0.01% to 3.0% by weight, based on the weight of total monomer. Redox systems using the same initiators coupled with a suitable reductant such as, for example, sodium sulfoxylate formaldehyde, sodium hydrosulfite, isoascorbic acid, and sodium bisulfite may be used at similar levels. Chain transfer agents such as mercaptans may be used to lower the molecular weight of the formed polymer of one or more of the stage polymers; the use of no chain transfer agent is preferred.

Such a process usually results in the formation of at least two mutually incompatible polymer compositions, thereby resulting in the formation of at least two phases. The mutual incompatibility of two polymer compositions and the resultant multiphase structure of the polymer particles may be determined in various ways known in the art. The use of scanning electron microscopy using staining techniques to emphasize the difference between the appearance of the phases, for example, is such a technique.

The average particle diameter of the emulsion-polymerized polymer particles is preferred to be from 30 nanometers to 500 nanometers.

The aqueous coating composition is prepared by techniques which are well known in the coatings art. First, at least one pigment is well dispersed in an aqueous medium under high shear such as is afforded by a COWLES (R) mixer or, in the alternative, at least one predispersed colorant is used. Then the multi-stage emulsion-polymer is added under low shear stirring along with other coatings adjuvants as desired. The aqueous coating composition may contain, in addition to the pigment(s) and the multi-stage emulsion polymer, conventional coatings adjuvants such as, for example, emulsifiers, coalescing agents, curing agents, buffers, neutralizers, thickeners, humectants, wetting agents, biocides, plasticizers, antifoaming agents, colorants, waxes, and anti-oxidants.

The solids content of the aqueous coating composition may be from about 10% to about 50% by volume. The viscosity of the aqueous polymeric composition may be from about 50 centipoise to about 10,000 centipoise, as measured using a Brookfield viscometer; the viscosities appropriate for different application methods vary considerably.

The aqueous coating composition may be applied to leather such as, for example, mineral tanned or vegetable tanned leather including full-grain leather, buffed or corrected-grain leather, and split leather with or without a prior treatment with an impregnating resin mixture using conventional coatings application methods such as, for example, curtain coater and spraying methods such as, for example, air-atomized spray, air-assisted spray, airless spray, high volume low pressure spray, and air-assisted airless spray.

EXPERIMENTAL METHODS

Print Quality

The print quality was evaluated by examining the embossed haircell pattern for distinctness and sharpness. The print quality was rated on a scale of 0 (worst; no pattern evident) to 10 (best; perfect transfer of pattern) with a minimum rating of 5 as acceptable.

Flexing Endurance of Coated Leather

The flexing endurance under wet or dry conditions is based on the IUF 20 method of International Union of Leather Chemists Association using a Bally Flexometer (Bally SchuhFabriken AG, Schoenenwerd, Switzerland). The dry or wet leather specimens (65 mm. by 40 mm.) were flexed and examined for damage after 100, 500, 1,000, 5,000, 10,000, 20,000, 40,000, 50,000, and 100,000 flexes. The number of cycles at which 10 or more small cracks first appeared in the leather coating was recorded. Each sample was run in duplicate and the smaller of the two numbers recorded in the Tables. Although the extent of finish damage sustained is dependent on the toughness of the polymer, it is also strongly dependent on the type of leather used. In the heavyweight splits used in these experiments, a minimum of 10,000 flexes under dry conditions and 5,000 under wet conditions is considered acceptable.

Wet Rub Resistance of Coated Leather

The Veslic rubbing resistance under wet conditions was performed using a SATRA (Shoe and Allied Trade Research Association) Rub Fastness Tester according to the Verein Schweizerischer Lederindustrie-Chemiker ("Veslic") Method C 4500. The dry leather specimen (115 mm. by 38 mm.) was rubbed with a wet felt pad (15 mm. by 15 mm. by 6 mm.) soaked with 1.0 g. of water loaded at 1 kg./cm.$^2$. The number of rubs (cycles) required to transfer a slight level of pigment to the felt pad was recorded. Each rub (cycle) consists of one forward and one backward motion. The felt pad was checked visually after every 25 cycles for signs of color.

Plate Release

The coated leather was embossed in a Turner-type press at 85–95C. and 70.3 kg/cm$^2$ (1000 psi) for 5–7 seconds and the ease of removability from the hot embossing press was evaluated. The ease of removability from the hot embossing press ("plate release") was evaluated on a scale of 0 (worst; requires considerable force to remove the coated leather and requires the plate to be cleaned afterward to remove coating residues) to 10 (best; coated leather falls freely from the plate), with a minimum rating of 4 (requires moderate force; comes off the plate cleanly).

The following examples are presented to illustrate the invention and the results obtained by the test procedures.

EXAMPLE 1

Preparation of first stage polymer dispersion—Comparative Samples A–G.

Preparation of Comparative Sample A. To a 5000 ml round bosom flask, fitted with a stirrer, condenser, temperature monitor and nitrogen flush, was added 1900 g of deionized water. A monomer premix was prepared from 340 g of deionized water, 89 g of sodium lauryl sulfate (28%), 1371.2 g ethyl acrylate and 13.8 g of acrylic acid. The entire monomer premix was transferred to the flask, with 60 mls of deionized water, followed at one minute intervals by 5 mls of a 0.15 % aqueous solution of ferrous sulfate heptahydrate, 0.3 g of ammonium persulfate dissolved in 8 g of deionized water and 1.6 g of sodium hydrosulfite dissolved in 20 g of deionized water and 0.3 g ammonium hydroxide. Within ten minutes the temperature increased to 75 C. When the temperature dropped below 55 C., 1.5 g t-butyl hydroperoxide in 25 g deionized water and 1.0 g sodium sulfoxylate formaldehyde dissolved in 25 g deionized water were added. At or below 40 C. 3.9 g of ZnO slurried with 20 g deionized water was added to the polymer dispersion. After an hour the polymer dispersion was filtered through a 100 mesh screen to remove coagulum. The resulting polymer dispersion was found to have 35.7% solids content, pH=7.0, and a Brookfield viscosity (LV spindle 2@60 rpm) of 12 cps.

Comparative Samples B–G were prepared in the same manner as Comparative Sample A except using the amounts of monomer and crosslinkers listed in Table 1.1; for Comparative Samples B–E the ZnO treatment was omitted; for Comparative Sample F, 1.0 equivalent of zinc per equivalent of acrylic acid was used.

TABLE 1.1

Quantities used in preparation of first stage polymers - Comparative Samples B–G

| | First Stage Composition | | |
|---|---|---|---|
| Comparative | EA | Acid | Other monomer |
| B | 1371.2 | 13.8 AA | |
| C | 1371.2 | 13.8 AA | 3.46 ALMA |
| D | 1371.2 | 13.8 AA | 27.7 BGDA |
| E | 1371.2 | 13.8 AA | 27.7 NMA |
| F | 1357.3 | 27.7 AA | |
| G | 1343.4 | 41.6 AA | |

Note:
EA = ethyl acrylate; AA = acrylic acid; ALMA = allyl methacrylate; BGDA = 1,4-butyleneglycol diacrylate; NMA = N-methylolacrylamide

EXAMPLE 2

Preparation of multi-stage emulsion-polymers—Samples 1–7 and Comparative Samples H–M.

Preparation of Sample 1. A 1900 g portion of Comparative Sample A, a first stage emulsion polymer, described in Example 1, taken before the temperature fell below 65 C. and the t-butylhydroperoxide and sodium sulfoxylate formaldehyde were added, was transferred to a 3000 ml flask, fitted with a stirrer, condenser, temperature monitor and nitrogen flush. At a temperature of 55–60 C., 76.9 g of methyl methacrylate was added. Two minutes later 0.15 g of t-butyl hydroperoxide in 5 g deionized water and 0.1 g of sodium sulfoxylate formaldehyde in 5 g of deionized water were added. The temperature increased 3–4 C. over about five minutes. When the temperature dropped below 55 C., 1.5 g t-butyl hydroperoxide in 25 g deionized water and 1.0 g sodium sulfoxylate formaldehyde dissolved in 25 g deionized water was added. With the temperature below 40 C., 3.9 g of ZnO slurried with 20 g deionized water was added to the polymer. After an hour the polymer dispersion was filtered. The resulting polymer dispersion was found to have 37.6% solids content, pH=6.9, and a Brookfield viscosity (LV spindle 2@60 rpm) of 17 cps.

Samples 2–7 and Comparative Samples H–M were prepared in the same manner as Sample 1 except using the ingredients listed in Table 2.1 and in place of Comparative Sample A, Comparative Sample H used Comparative Sample B, Comparative Sample I used Comparative Sample C, Comparative Sample J used Comparative Sample D, Comparative Sample K used Comparative Sample E, Comparative Sample L used Comparative Sample F, and Samples 2–7 and Comparative Sample M used Comparative Sample G.

TABLE 2.1

Quantities used in the preparation of multi-stage emulsion-polymers Samples 2–7 and Comparative Samples H–M.

| | Second Stage Composition | | | |
|---|---|---|---|---|
| Sample | MMA | EA | Other | ZnO |
| Comp. H | 76.9 | | | |
| Comp. I | 76.9 | | | |
| Comp. J | 76.9 | | | |
| Comp. K | 76.9 | | | |
| Comp. L | 76.9 | | | |
| 2 | 36.4 | | | 11.7 |
| 3 | 76.9 | | | 11.7 |
| 4 | 231 | | | 11.7 |
| Comp. M | | 76.9 | | 11.7 |
| 5 | 25.4 | 51.5 | | 11.7 |
| 6 | 51.5 | 25.4 | | 11.7 |
| 7 | 73.1 | | 3.8 MAA | 11.7 |

Note:
abbreviations as for Table 1.1; MAA = methacrylic acid; (quantities in grams).

EXAMPLE 3

Preparation of multi-stage emulsion polymers—Samples 8–12

Samples 8 and 9 were prepared using the Sample 1 process with the levels of monomer and ZnO indicated in Table 3.1. The Comparative Sample A which was made for these examples was prepared at half of the batch size of Example 1. The entire batches were used (1900 g) to prepare Samples 8–9.

Samples 10 and 11 were prepared by second staging a full batch of Comparative Sample A prepared as in Example 1, using the levels of monomer listed in Table 3.1 for Sample 10. Therefore, twice the amount of ingredients were used to make this multi-stage polymer than described for Sample 1. The batch was split in half for the final step. Sample 10 consisted of 2044 g of this polymer to which 9.8 g of ZnO in 50 g of water was added. Sample 11 consisted of the remaining 2044 g of the polymer to which was added 19.5 g of ZnO in 100 g of water.

Sample 12 was made by the Sample 1 process except the second stage was a semi-continuous polymerization. It was prepared by second staging an entire batch of Comparative Sample A prepared as in Example 1, using the ingredients listed in Table 3.1. The second stage monomer, 244.4 g of MMA, 0.3 g of t-buyl hydroperoxide in 50 g deionized water and 0.2 g of sodium sulfoxylate formaldehyde in 50 g deionized water were added over 20 minutes. This was followed by the addition of 50 g of deionized water, 3.0 g t-butyl hydroperoxide in 50 g deionized water and 2.0 g sodium sulfoxylate formaldehyde dissolved in 50 g deionized water. At or below 40 C., 15.7 g of ZnO slurried with 84.3 g of deionized water was added to the polymer. After an hour the polymer dispersion was filtered.

TABLE 3.1

Quantities (in grams) used in preparation of multi-stage emulsion polymer Samples 8–12.

| | First Stage Monomer | | | Second Stage | |
|---|---|---|---|---|---|
| Sample | EA | Other | Acid | MMA | ZnO |
| 8 | 533.2 | 138.5 BA | 20.8 AA | 76.9 | 11.7 |
| 9 | 667.6 | | 24.9 MAA | 76.9 | 11.7 |
| 10 | 1315.8 | | 69.2 AA | 154 | 9.8 |
| 11 | 2230 g. of sample 10 polymer | | | | 19.5 |
| 12 | 1357.3 | | 27.7 AA | 244.4 | 15.7 |

EXAMPLE 4

Preparation of Coated leather

All multi-stage emulsion polymers and Comparative Samples were evaluated as leather coating compositions in the split leather basecoat formulation given in Table 4.1. (all quantifies in grams of the products on an as provided basis) The formulation ingredients were mixed in the order shown below with brief mixing by hand after the addition of each ingredient. The leather coating compositions were filtered through cotton cheesecloth to remove coagulum. The viscosities of the leather coating compositions as measured by the Zahn Signature Series #2 cup were between 15 and 20 seconds.

TABLE 4.1

Leather coating formulation

| | |
|---|---|
| PRIMAL(R) Leveler MK-1 | 1 |
| PRIMAL(R) Binder C-7 | 8 |
| PRIMAL(R) LA Neutral | 12 |
| Black Pigment (1) | 21 |
| Emulsion Polymer | 58 |

Notes:
PRIMAL(R) is a trademark of the Rohm and Haas Company.
(1) Pigment used was Stahl P4812 Jet Black Pigment.

The formulation was sprayed using an air-atomized spraygun in three coats onto pieces (21.6 cm. by 27.9 cm.) cut from heavyweight (2.2 min.) T. Red Brown Upper Split crust leather from the A. L. Gebhardt Company, for a total wet coat weight of about 430 g/m.$^2$ (40 g/ft$^2$). The coating was dried at 60 C. for about 10 minutes after each application. The coated leather was then embossed in a Turner-type press at 85–95 C. and 70.3 kg/cm$^2$ (1000 psi) for 5–7 seconds and the ease of removability from the hot embossing press was evaluated. The pieces were then sprayed with dilute HYDRHOLAC(R) WC-230 aqueous nitrocellulose emulsion (HYDRHOLAC(R) is a trademark of Rohm and Haas Company) as a topcoat at a coat weight of 21–32 g/m$^2$ (2–3 g/ft$^2$).

EXAMPLE 5

Effect of second stage polymer and ZnO crosslinker on performance of leather coated with an aqueous coating composition containing polymer emulsions.

TABLE 5.1

| Coated leather properties. | Sample | | | |
|---|---|---|---|---|
| | Comp. B | Comp. A | Comp. H | 1 |
| second stage | none | none | 10 MMA | 10 MMA |
| crosslinker | none | ZnO | none | ZnO |
| plate release | 3 | 4 | 3 | 4 |
| print quality | 7 | 6 | 8 | 8 |
| dry Bally | 5,000 | 10,000 | 10,000 | 10,000 |
| wet Bally | 5,000 | 10,000 | 20,000 | 40,000 |
| wet Veslic | 75 | 100 | 100 | 200 |

Sample 1 of this invention demonstrates the advantages of incorporating both a second stage polymer and transition metal oxide crosslinking relative to the Comparative Samples absent one or both of those features.

EXAMPLE 6

Effect of Various Crosslinkers on the properties of coating compositions containing a multi-stage emulsion polymer

TABLE 6.1

| Coated leather properties | Sample | | | | |
|---|---|---|---|---|---|
| | Comp. H | Comp. I | Comp. J | 1 | Comp. K |
| crosslinker | none | ALMA | BGDA | ZnO | NMA |
| plate release | 3 | 4 | 8 | 4 | 1 |
| print quality | 8 | 7 | 7 | 8 | 8 |
| dry Bally | 10,000 | 5,000 | 1,000 | 10,000 | 5,000 |
| wet Bally | 20,000 | 10,000 | 500 | 40,000 | 5,000 |
| wet Veslic | 100 | 50 | 25 | 200 | 75 |

The effect of various crosslinkers on 2-stage compositions is shown here. The addition of ZnO to 2-stage polymer (Sample 1 of this invention) leads to improved wet Bally flex resistance as well as improved wet Veslic rub resistance relative to Comparative Samples H—K.

EXAMPLE 7

Effect of Various Levels of MMA second stage on coatings properties of coating compositions containing multi-stage emulsion polymers having a 97 EA/3 AA first stage.

TABLE 7.1

| Coated leather properties | Sample | | | |
|---|---|---|---|---|
| | Comp. G | 2 | 3 | 4 |
| 2nd stage (%) | none | 5 | 10 | 25 |
| crosslinker | ZnO | ZnO | ZnO | ZnO |
| plate release | 6 | 7 | 6 | 6 |
| print quality | 7 | 6 | 7 | 8 |
| dry Bally | 100,000 | 100,000 | 50,000 | 5,000 |
| wet Bally | 5,000 | 5,000 | 5,000 | 1,000 |
| wet Veslic | 75 | 150 | 150 | 600 |

The dry and wet Bally flex resistance decrease and the wet Veslic rub resistance improves with increasing 2nd stage level. Samples 2–4 of this invention being superior to Comparative Sample G.

EXAMPLE 8

Effect of Tg of the second stage on the coatings properties of coating compositions containing multi-stage emulsion polymers

TABLE 8.1

| Coated leather properties | Sample | | | | |
|---|---|---|---|---|---|
| | 3 | 7 | 6 | 5 | Comp. M |
| second stage Tg, (C.) | 105 | 108 | 57 | 23 | −10 |
| crosslinker | ZnO | ZnO | ZnO | ZnO | ZnO |
| plate release | 6 | 5 | 6 | 5 | 4 |
| print quality | 7 | 3 | 5 | 6 | 2 |
| dry Bally | 50,000 | 50,000 | 100,000 | 100,000 | 100,000 |
| wet Bally | 5,000 | 5,000 | 20,000 | 5,000 | 1,000 |
| wet Veslic | 150 | 150 | 175 | 125 | 75 |

The effects of varying the 2nd stage Tg by using different ratios of MMA and EA are shown. The second stage Tgs are calculated from the Tgs of the homopolymers using the calculation method of Fox (Bull. Am. Phys. Soc., 1956, 1(3), 123). The Tgs of the homopolymers are those determined by the mid-point DSC method described herein-above, in particular: ethyl acrylate −10 C., methyl methacrylate 105 C., and methacrylic acid 185 C. If the 2nd stage glass transition temperature is similar to that of the 1st stage (Comparative Sample M), the wet Veslic rub resistance, print quality, and wet Bally are unacceptable. The second stage glass transition temperature must be at least 10 C. higher than that of the first stage in order to achieve a balance of good Bally flex resistance and wet Veslic rub resistance.

EXAMPLE 9

Effect of Various first stage Compositions on coating properties

TABLE 9.1

| Coated leather properties | Sample | | | | |
|---|---|---|---|---|---|
| | 8 | 9 | 10 | 11 | 12 |
| 1st stage (BA) | 20 | 0 | 0 | 0 | 0 |
| 1st stage (AA) | 3 | 0 | 5 | 5 | 2 |
| 1st stage (MAA) | 0 | 3.6 | 0 | 0 | 0 |
| 2nd stage (MMA) | 10 | 10 | 10 | 10 | 15 |
| ZnO crosslinker (eq) | 1 | 1 | 0.5 | 1 | 1 |
| plate release | 6 | 3 | 5 | 5 | 4 |
| print quality | 8 | 8 | 1 | 4 | 7 |
| dry Bally | 40,000 | 10,000 | 20,000 | 20,000 | 10,000 |
| wet Bally | 5,000 | 5,000 | 5,000 | 1,000 | 5,000 |
| wet Veslic | 100 | 100 | 100 | 150 | 150 |

Superior coating properties were also obtained when other monomers such as BA instead of EA, or MAA instead of AA were used. Higher levels of acid (Samples 10 and 11) may be used. The process may also be a semicontinuous process as shown by the coating containing Sample 12.

EXAMPLE 10

Effect of pH during ZnO Addition on Coatings Properties

Samples 13, 14, and 15 of this invention were prepared by adding ZnO (1 equivalent of zinc based on the equivalents of first stage polymer acid) to Comparative Sample L which had been adjusted with ammonium hydroxide to the pHs indicated in Table 10.1.

TABLE 10.1

| Coated leather properties | Sample | | | |
|---|---|---|---|---|
| | Comp. L | 13 | 14 | 15 |
| pH | 4 | 4 | 6 | 8 |
| ZnO (eq) | 0 | 1 | 1 | 1 |
| plate release | 1 | 7 | 7 | 4 |
| print quality | 10 | 7 | 6 | 6 |
| dry Bally | 20,000 | 40,000 | 20,000 | 20,000 |
| wet Bally | 20,000 | 5,000 | 5,000 | 5,000 |
| wet Veslic | 50 | 100 | 100 | 100 |

Samples 13–15 of this invention in a leather coating composition exhibit the effect of pH of the emulsion when the ZnO is added. The ZnO effectively crosslinks the polymer at acidic pH (4), near neutral (6), or basic pH (8), as shown by the leather coating results. The most noticeable effect of crosslinking is to improve the embossing plate release.

EXAMPLE 11

Benefit of addition of ZnO rather than soluble zinc ammonium complexes to aqueous multi-stage emulsion polymer.

One equivalent of zinc was added to a two stage emulsion polymer, Comparative Sample N [90(97.2 EA/2.8 AA)//10 MMA], either as a 25% zinc oxide slurry in water at a pH less than 9 or as a zinc ammonium bicarbonate solution (8.4% zinc as metal; as described in U.S. Pat. No. 5,149,745) ("sol. Zn"). The zinc oxide slurry or soluble zinc solution was added dropwise with stirring. The mixture was allowed to stand for 1 hour and then filtered through a 325 mesh nylon filter. The coagulum was dried at 110 C. and weighed. The results are shown in Table 11.1.

TABLE 11.1

| Results of addition of ZnO or zinc ammonium complex to aqueous multi-stage emulsion polymer. | |
|---|---|
| Sample | Coagulum (grams per 100 g. emulsion polymer) |
| Comp. N | 0 |
| Comp. N + ZnO | 0.1 |
| Comp. N + sol. Zn | 3.6 |

The method of this invention, contacting Comparative Sample N with ZnO, is superior to the method using soluble zinc ammonium complexes as undesirable coagulum is substantially not formed.

What is claimed is:

1. A method for coating leather comprising (a) forming an aqueous coating composition comprising a multi-stage aqueous emulsion-polymer formed by a method comprising sequentially (i) forming a predominantly acrylic first stage polymer comprising at least one copolymerized ethylenically unsaturated monomer and from 0.5% to 10% of a copolymerized monoethylenically-unsaturated carboxylic acid monomer, based on the weight of said first stage polymer, said first stage polymer being substantially free from copolymerized multi-ethylenically unsaturated monomer; and said first stage polymer having a Tg of less than 20 C.;

(ii) contacting said first stage polymer with a transition metal oxide, hydroxide, or carbonate at a pH of less than 9 in an amount greater than 0.1 equivalent of transition metal per equivalent of said copolymerized carboxylic acid monomer in said first stage polymer; and (iii) forming a second stage polymer comprising at least one copolymerized ethylenically unsaturated monomer and from 0 to 10% of a copolymerized monoethylenically-unsaturated carboxylic acid monomer, based on the weight of said second stage polymer, provided that said second stage copolymerized carboxylic acid monomer is less than 25%, by weight, of the total copolymerized carboxylic acid monomer in said multi-stage emulsion polymer, said second stage polymer being substantially free from copolymerized multi-ethylenically unsaturated monomer; said second stage polymer having a Tg of greater than 20 C. and at least 10 C. higher than the Tg of said first stage polymer; and said second stage polymer being from 1% to 50% of the weight of said first stage polymer, based on dry polymer weights;

(b) applying said coating composition to leather; and (c) drying said coating composition.

2. The method of claim 1 wherein said copolymerized monoethylenically-unsaturated carboxylic acid monomer in said first stage polymer is selected from acrylic acid and itaconic acid.

3. The method of claim 1 wherein said transition metal oxide, hydroxide, or carbonate is zinc oxide.

4. An aqueous composition for use in coating leather comprising a multi-stage aqueous emulsion-polymer comprising (i) a predominantly acrylic first stage polymer comprising at least one copolymerized ethylenically unsaturated monomer and from 0.5% to 10% of a copolymerized monoethylenically-unsaturated carboxylic acid monomer, based on the weight of said first stage polymer, said first stage polymer being substantially free from copolymerized multi-ethylenically unsaturated monomer; and said first stage polymer having a Tg of less than 20 C.; said first stage polymer having been contacted with a transition metal oxide, hydroxide, or carbonate at a pH of less than 9 in an amount greater than 0.1 equivalent of transition metal per equivalent of said copolymerized carboxylic acid monomer in said first stage polymer; and (ii) a second stage polymer comprising at least one copolymerized ethylenically unsaturated monomer and from 0% to 10% of a copolymerized monoethylenically-unsaturated carboxylic acid monomer, based on the weight of said second stage polymer, provided that said second stage copolymerized carboxylic acid monomer is less than 25%, by weight, of the total copolymerized carboxylic acid monomer in said multi-stage emulsion polymer, said second stage polymer being substantially free from copolymerized multi-ethylenically unsaturated monomer; said second stage polymer having a Tg of greater than 20 C. and at least 10 C. higher than the Tg of said first stage polymer; and said second stage polymer being from 1% to 50% of the weight of said first stage polymer, based on dry polymer weights.

5. The composition of claim 4 wherein said copolymerized monoethylenically-unsaturated carboxylic acid monomer in said first stage polymer is selected from acrylic acid and itaconic acid.

6. The composition of claim 4 wherein said transition metal oxide, hydroxide, or carbonate is zinc oxide.

* * * * *

UNITED STATES PATENT AND TRADEMARK OFFICE

CERTIFICATE OF CORRECTION

PATENT NO. : 5,723,182

DATED : March 3, 1998

INVENTOR(S) : Chol-Yoo Choi et al.

It is certified that error appears in the above-indentified patent and that said Letters Patent is hereby corrected as shown below:

Col. 3, line 42
replace "used in an mount effective to provide lower molecular"
with --used in an amount effective to provide lower molecular--.

Col. 3, line 66
replace "carboxylic acid monomer in the multi-stage copolymer;"
with --carboxylic acid monomer is less than 25%, by weight, of the total copolymerized carboxylic acid monomer in the multi-stage copolymer; --.

Col. 6, line 8
replace "round bosom flask"
with --round bottom flask, --.

Col. 8, line 28
replace "quantifies in grams of the"
with --quantities in grams of the --.

Signed and Sealed this

FourthDay of August, 1998

Bruce Lehman

*Attest:*

*Attesting Officer*

BRUCE LEHMAN

*Commissioner of Patents and Trademarks*